US009325099B2

(12) United States Patent
Coughlan et al.

(10) Patent No.: US 9,325,099 B2
(45) Date of Patent: Apr. 26, 2016

(54) COUPLING SYSTEM INCLUDING A RECEPTACLE HOUSING WITH A ROTATING DOMED DOOR

(71) Applicant: Hypertronics Corporation, Hudson, MA (US)

(72) Inventors: Christopher D. Coughlan, Hudson, MA (US); David E. Salomon, Framingham, MA (US); Arkady Shinder-Lerner, Framingham, MA (US); Eric R. Stauble, Groveland, MA (US)

(73) Assignee: Hypertronics Corporation, Hudson, MA (US)

( * ) Notice: Subject to any disclaimer, the term of this patent is extended or adjusted under 35 U.S.C. 154(b) by 0 days.

(21) Appl. No.: 14/160,294

(22) Filed: Jan. 21, 2014

(65) Prior Publication Data

US 2014/0206211 A1 Jul. 24, 2014

Related U.S. Application Data

(60) Provisional application No. 61/755,258, filed on Jan. 22, 2013.

(51) Int. Cl.
*H01R 13/44* (2006.01)
*H01R 13/447* (2006.01)

(52) U.S. Cl.
CPC ..... *H01R 13/447* (2013.01)

(58) Field of Classification Search
CPC ..... H01R 2201/26; H01R 13/447; H01R 13/6397; H01R 13/62; H01R 13/62933; B60D 1/62
USPC ..... 439/34–35, 135–136, 142, 144, 304, 439/305, 310
See application file for complete search history.

(56) References Cited

U.S. PATENT DOCUMENTS

| | | | | |
|---|---|---|---|---|
| 4,245,875 | A * | 1/1981 | Shaffer | H01R 27/00 439/144 |
| 4,784,610 | A * | 11/1988 | Stuart | H01R 13/633 174/67 |
| 5,385,476 | A * | 1/1995 | Jasper | H01R 13/6633 336/90 |
| 5,582,521 | A * | 12/1996 | Mori | B60L 11/1818 439/142 |
| 6,039,602 | A * | 3/2000 | Witkowski | H01R 23/10 439/550 |
| 6,554,626 | B2 * | 4/2003 | Ramos, Jr. | H01R 13/405 439/144 |
| 6,749,438 | B1 * | 6/2004 | Scheller | B60D 1/62 439/35 |
| 7,331,792 | B2 * | 2/2008 | Cummings | H01R 13/5213 439/166 |
| 7,575,450 | B2 * | 8/2009 | Williams | H01R 13/639 439/144 |
| 8,016,604 | B2 * | 9/2011 | Matsumoto | B60L 3/0069 439/304 |
| 8,152,550 | B2 * | 4/2012 | Ichio | H01R 13/5227 439/304 |

(Continued)

*Primary Examiner* — Thanh Tam Le
(74) *Attorney, Agent, or Firm* — Snell & Wilmer LLP

(57) ABSTRACT

Coupling system housings including a receptacle housing with a domed protective door and a male coupler housing that may be used to actuate the receptacle housing door are disclosed. The receptacle housing may be mounted in a receiving structure. The receptacle housing is configured with a dome-shaped door that conceals and protects the connectors of an assembled receptacle when in the closed position. The receptacle housing also includes a biasing mechanism that urges the door to a closed position and maintains the door in its closed position when a male coupler is not mated to the receptacle. The male coupler housing is configured with an ergonomic handle suitable for one handed operation of the male coupler. The male coupler housing may be used to actuate the receptacle housing door during insertion and mating of and assembled male coupler to an assembled receptacle.

17 Claims, 21 Drawing Sheets

(56) References Cited

U.S. PATENT DOCUMENTS

| | | | | |
|---|---|---|---|---|
| 8,288,651 | B2 * | 10/2012 | Smith | H01R 13/5205 174/135 |
| 8,502,499 | B2 * | 8/2013 | Xiao | A61K 31/661 180/65.1 |
| 8,523,589 | B2 * | 9/2013 | Kurumizawa | H01R 13/6275 439/304 |
| 8,740,283 | B2 * | 6/2014 | Yamamaru | B60L 11/1818 296/136.01 |
| 2004/0053525 | A1 | 3/2004 | Matsuo et al. | |
| 2006/0172579 | A1 | 8/2006 | Murphy et al. | |
| 2008/0194137 | A1 | 8/2008 | Kuo | |
| 2008/0233773 | A1 | 9/2008 | Meleck | |
| 2010/0081908 | A1 | 4/2010 | Dobbles et al. | |

* cited by examiner

COUPLING SYSTEM INCLUDING A RECEPTACLE HOUSING WITH A ROTATING DOMED DOOR

CROSS REFERENCE TO RELATED APPLICATIONS

This application claims the benefit and priority of U.S. Provisional Application No. 61/755,258, filed Jan. 22, 2013, entitled "Coupling System including a Receptacle Housing with a Rotating Domed Door." The entire disclosure of the provisional application is hereby incorporated by reference herein.

BACKGROUND

1. Field

The present invention relates generally to coupling systems and improvements thereto. More particularly, the present invention relates to coupling system housings including a receptacle housing having a self-closing, door that conceals and protects the coupler module of a receptacle. The door may be, for example, dome-shaped, flat, concave, or in other shapes. The coupling system housings may also include a male, female or hermaphroditic coupler housing. The coupler housing may be used to actuate the receptacle door to expose the coupler module of the receptacle and permit insertion of an assembled coupler to complete a connection between the coupler and the receptacle.

2. Description of the Related Art

Coupling systems for providing an interface between various devices or components of a system are widely used in a variety of applications. For example, typical electrical coupling systems utilize a mated pair of connectors that include a series of complementary pins, sockets, or other conductive contacts to provide electrical connections between electronic devices. When the connectors are mated, the conductive contacts are electrically connected, thereby electrically connecting the two devices. In addition to electrical connectors, other types of connectors such as, for example, optical, hydraulic, pneumatic, or vacuum connectors or fittings may be used in a coupling system to interconnect components of other types of systems.

In certain settings, coupling systems including connectors of any of a variety of types such as those listed above may be engaged and disengaged frequently over a period of a time based on the functions or uses of the associated devices and the requirements of the operator or user. Likewise, coupling systems or portions thereof, such as a receptacle housing, may be physically associated with furniture, equipment, or the like, that may be used in settings or environments requiring mobility, frequent reconfiguration, cleaning or various other manipulations and generally be subject to conditions that may increase a risk of damage to exposed connectors. While protective enclosures or covers for receptacles are well known, they can suffer from problems such as structural or mechanical fragility rendering them generally unreliable and unsuitable for applications such as those described above. Protective enclosures or covers may also increase the effort or the complexity of the action required to expose the connectors housed within a receptacle and to complete a connection with them by mating the corresponding male coupler.

Therefore, a need exists for improved coupling system housings that include a receptacle housing with a protective door capable of providing robust protection of the connectors that may be housed within the assembled receptacle. Ideally, coupling system housings would include a receptacle housing with a self-closing door capable of providing physical protection of the connectors housed in the assembled receptacle when not in use while being configured for simple actuation of the door and mating of a male coupler by a user. Likewise, the corresponding male coupler housing would be ergonomically configured for facile, one-handed manipulation by a user and permit the user to actuate the receptacle door with the assembled male coupler in the course of a male coupler insertion and mating process.

SUMMARY

Coupling system housings are disclosed that include a female coupling housing with a self-closing protective door and a male coupler housing that may be used to actuate the door of the female coupling housing. The female coupling housing may be, for example, a receptacle housing. The receptacle housing and the male coupler housing disclosed herein may be used to enclose and retain connectors such that the resultant coupling system may be used to make electrical, optical, hydraulic, pneumatic, vacuum, other connections, or combinations thereof between remote devices that may be connected to an assembled receptacle and male coupler when the receptacle and male coupler are mated.

In accordance with various embodiments, a receptacle housing may include a bezel portion and a coupler module portion. The coupler module portion may be, for example, a connector module portion for connecting a male coupler to a receptacle. The bezel portion comprises the outer surface of the receptacle housing and defines an opening that provides access to one or more connectors that may be included in the coupler module portion of an assembled receptacle. The receptacle housing further includes a door that conceals the opening of the receptacle housing when the door is in the closed position and retracts behind the outer surface of the receptacle housing in the open position to expose the opening and the connectors of an assembled receptacle, thereby allowing mating of a male coupler. The door may be, for example, dome-shaped, flat, concave, or in other shapes. Although references are made to a male coupler or housing, a female coupler or housing and/or a receptacle, each of the couplers or housings may instead be a male, female, hermaphroditic coupler or housing, or other types of coupler or housings based on design specifications and concerns.

The receptacle housing also includes a door biasing mechanism that urges the door toward the closed position when a male coupler is not mated to the assembled receptacle in order to conceal the opening of the assembled receptacle and to protect the connectors therein from environmental contaminants or physical damage that might be caused by external forces. The bezel portion and/or the door of the receptacle housing may include various features that facilitate one-handed actuation of the door by a user with an assembled male coupler during a coupler mating process. The receptacle housing may also include features that permit mounting or attachment of the receptacle housing to a receiving structure.

A male coupler housing in accordance with various embodiments may include a shell with a pistol-grip shape. The shell has an elongated portion and a mating portion extending approximately orthogonally from the longitudinal axis of the elongated portion. The elongated portion has a tail end defining an opening through which conductive leads, wires, tubing, hoses, or other conduit may extend to a remote device. The mating portion secures a coupler platform. The coupler platform may be, for example, a connector platform configured with one or more connectors to form an assembled male coupler. The mating portion further has a mating end defining an opening whereby the connectors of the assembled male coupler may be mated with the corresponding connectors of an assembled receptacle.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Devices and systems that implement the embodiment of the various features of the present disclosure will now be described with reference to the drawings. The drawings and the associated descriptions are provided to illustrate some embodiments of the present disclosure and not to limit the scope of the present disclosure. The embodiments illustrated share various similar features, each of which may be described herein with reference to the various illustrated embodiments and with alternation between illustrations of the various embodiments.

Turning to the figures, FIGS. 1A-3 illustrate a receptacle housing 100 in accordance with various embodiments. Conductive contacts are shown in FIGS. 1A-3 to illustrate a receptacle housing 100 partially assembled to contain electrical connectors in the coupler module portion. However, the coupler module portion of a receptacle housing in accordance with various embodiments may be configured to accept or retain any of a variety of connectors, including, for example, hydraulic, pneumatic, or vacuum fittings or connectors, optical fiber connectors and the like. Similarly, the coupler module portion of a receptacle housing may be configured to accept or retain various types of connectors within the same assembled receptacle, such that the receptacle housing may be used as a part of a multi-coupling system wherein a single coupling system may be used to simultaneously establish or discontinue, for example, electrical, optical, and hydraulic interconnections between two or more devices upon mating or unmating of the coupling system.

Figure 1A:
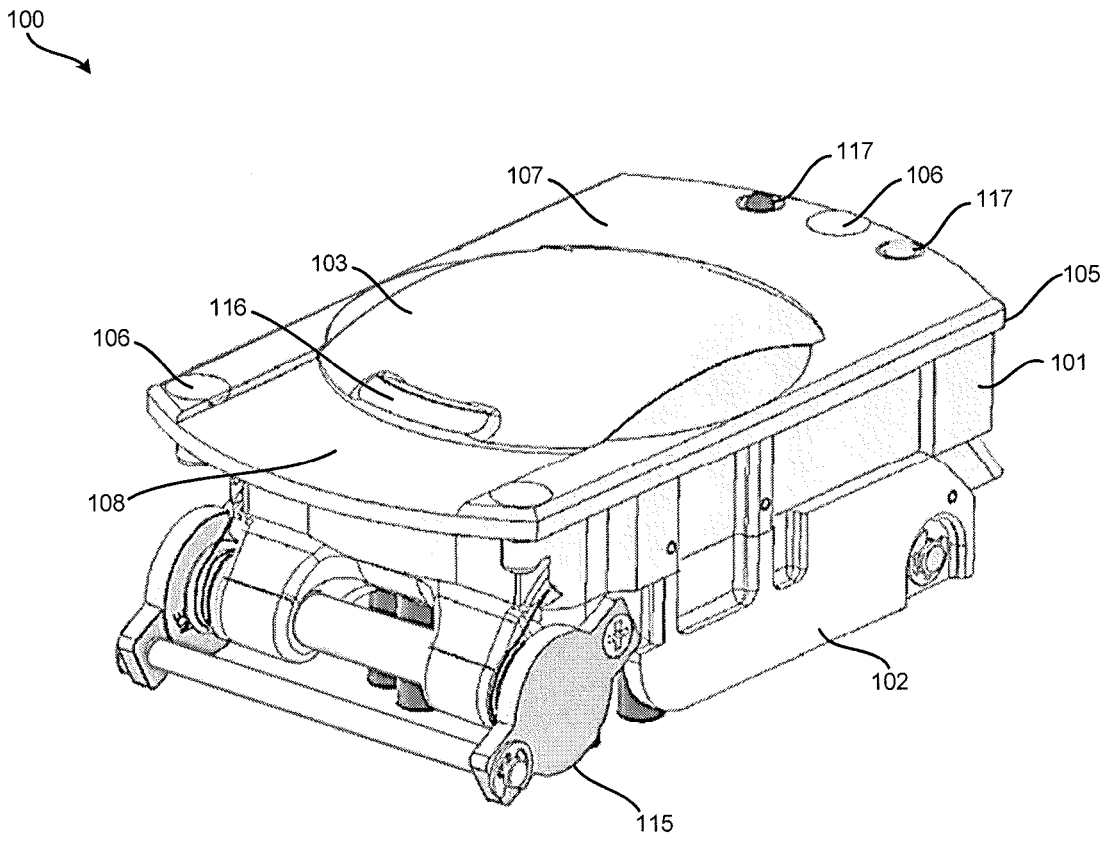
FIG. 1A is a perspective view (from above) of a receptacle housing with a closed door in accordance with various embodiments.
Figure 1B:
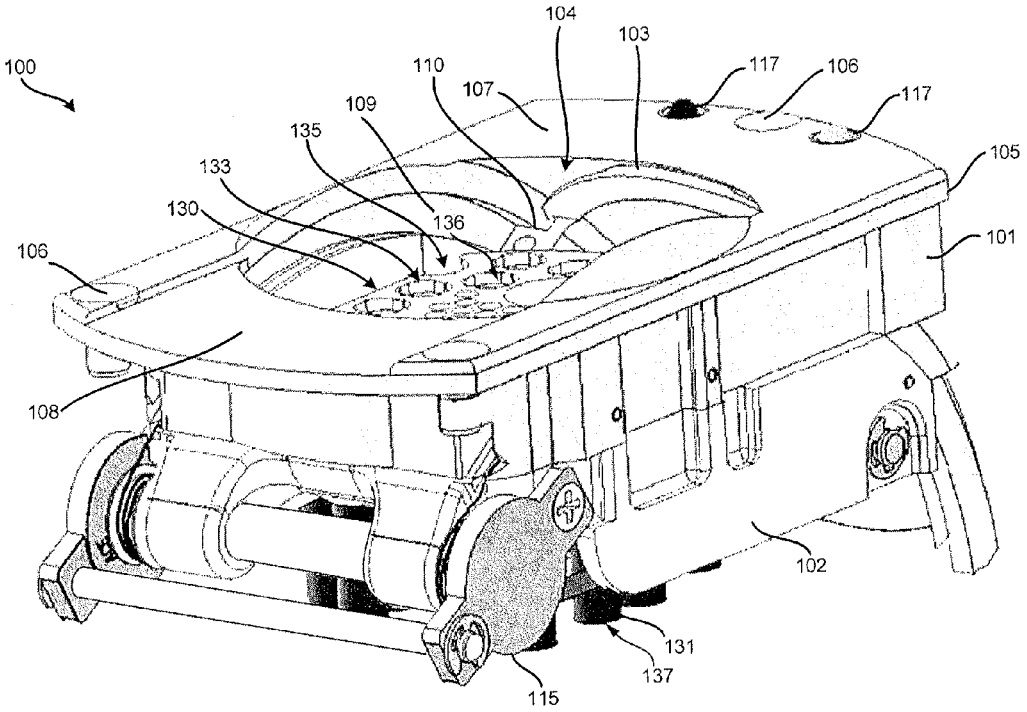
FIG. 1B is a perspective view (from above) of receptacle housing with an open door in accordance with various embodiments.

FIGS. 1A-1B show perspective views of a receptacle housing 100 in accordance with various embodiments. The receptacle housing 100 may have a bezel portion 101 comprising an outer surface of the receptacle housing, as well as a coupler module portion 102 comprising a back of the receptacle housing and configured to secure the connectors of an assembled receptacle. The receptacle housing may also include a door 103 that further comprises an outer surface of the receptacle housing 100 when in a closed position, as illustrated in FIG. 1A. When closed, the door 103 may conceal an opening 104 defined by the bezel portion 101 of the receptacle housing configured to provide access to connectors such as the conductive contacts or sockets illustrated in the coupler module portion 102 of the receptacle housing. The opening 104 defined by the bezel portion 101 is illustrated in FIG. 1B, which shows a receptacle housing 100 in accordance with various embodiments with a door 103 in an open position.

In accordance with various embodiments, a receptacle housing 100 may comprise a bezel portion 101 and a coupler module portion 102, wherein each portion is a separate component. In such embodiments, a bezel portion 101 and a coupler module portion 102 may be permanently or removably attached to one another using any of a variety of means, such as by bolts, screws, pins, interference fit connections, adhesives, or any combination of the foregoing. In various other embodiments, a bezel portion and a coupler module portion may have a unitary construction and be molded or machined from a single piece of material, with various other components of the receptacle described herein added or attached to the unitary bezel portion and coupler module portion to construct a complete receptacle housing.

The bezel portion of a receptacle housing may include various features for mounting or attaching the receptacle housing to another structure. For example, the receptacle housing may be configured to fit within a cavity in the surface of a receiving structure (not shown) such as a hospital bed. The bezel portion of a receptacle housing may provide for both an aesthetic interface between a receiving structure to which the receptacle housing is mounted as well as structural means for mechanical attachment of the receptacle housing to the receiving structure. In various embodiments, a peripheral edge of the bezel portion at its outer surface may define a flange 105 suitable for being seated on and/or attaching to a supporting portion of the receiving structure. The perimeter of the flange may be configured to overlap or adjoin the surface of the surrounding structure. The flange may also include attachment points, such as bolt holes 106, for securing the receptacle to the receiving structure. In accordance with various other embodiments, a coupler module portion of a receptacle housing may provide for and/or contribute to seating and attachment of the receptacle housing to a receiving structure.

In various embodiments, the bezel portion of the receptacle housing may be configured so that a primary field or surface area of the outer surface of the bezel portion is raised relative to the surface of the supporting structure immediately adjacent to the bezel portion. For example, and with reference to FIG. 10 in addition to FIGS. 1A-1B, the primary field 107 of the outer surface of the bezel portion may be configured such that the perimeter of the bezel defines a surface. In one embodiment, the defined surface may be raised with respect to an outer surface 501 of a receiving structure 500. For example, and without limiting the scope of the present invention, the surface may be raised approximately 1 mm. In one embodiment, the bezel may be flush with the outer surface 501 of a receiving structure 500. In accordance with various embodiments, this feature may facilitate tactile identification of the location and orientation of the receptacle by a user, for example, during a process of mating a male coupler with a receptacle. In other embodiments, the primary field of the bezel may be raised more or less than 1 mm with respect to the surrounding surface, for example, 0.75 mm, 1.5 mm, or 2 mm. Any dimension by which the perimeter of a bezel portion may be raised with respect to a surrounding surface and facilitate tactile identification of the receptacle housing is within the scope of the present disclosure.

A section of the outer surface of the bezel portion may be recessed relative to the primary field 107 of the outer surface and configured such that the recessed section of the outer surface is substantially flush with the surrounding surface of the receiving structure. As shown, for example, in FIGS. 1A, 1B and 8-15, such a recessed section of the outer surface may comprise a runway 108 that can be used to locate and guide a mating end 342 of a male coupler housing 300 configured to be physically inserted into and matingly connected to an assembled receptacle. The edges of a runway 108 may be configured to engage opposite outer edges of the mating end 342 of a corresponding male coupler (as shown, for example, in FIGS. 6A, 6B and 8-11 and provide for lateral and rotational alignment of the male coupler with the opening in the bezel portion of the receptacle housing. The runway 108 can serve as a guide for the mating end 342 through a first sliding movement of a male coupler from the periphery of the bezel portion to the opening of the receptacle housing by a user during a process of mating the male coupler with an assembled receptacle.

As described in greater detail below, the male coupler may engage the door 103 of the receptacle housing in the closed position and actuate the door from the closed position to the open position during the first sliding movement of the male coupler by a user in the process of mating the male coupler and an assembled receptacle. Upon reaching the open position, the door and/or the bezel portion may prohibit any further sliding, stopping the male coupler in a position from which it may be inserted into the opening of the bezel portion and physically mated with an assembled receptacle in a second inserting movement by the user to establish conductive connections between the male coupler and the assembled receptacle. As used herein, the term "conductive connections" may be used to refer to electrically conductive connections as well as other types of connections such as optically conductive connections or connections that may provide for fluid communication of a gas or liquid.

In various embodiments, the bezel portion of a receptacle housing may include features such as indicators that signal the connected or unconnected status of an assembled receptacle. For example, and referring again to FIGS. 1A-1B, the bezel portion 101 may include one or more status indicators 117, such as the illustrated pair of LED lights, that signal the status of an assembled receptacle. In various embodiments, one status indicator 117, for example, a red light, may be lit when the receptacle is in a powered or ready but unmated state. In accordance with various embodiments, the presence of an activated indicator light for the receptacle in the unmated state may further provide light and/or guidance for an operator seeking to locate and mate a male coupler with an assembled receptacle in a dimmed or darkened room. A second status indicator, for example, a green light, may be activated when a male coupler is mated to the receptacle. In accordance with various embodiments, an indicator light may be activated using any type of sensor or circuit that may variously be triggered by completion of an electrical circuit due to mating of a male coupler with an assembled receptacle or any other type of electrical or mechanical sensor that may be located in or otherwise associated with a receptacle housing and/or a male coupler housing.

In various embodiments, a door of a receptacle housing may be dome-shaped. As used herein, the term "dome-shaped" or "domed" is not limited to regular geometric shapes such as a half or other segment of a sphere. Rather, as used in the present disclosure, the terms "dome-shaped" or "domed" include any shape comprising a plane that may be curved along one or both axes. For example, a dome-shaped door in accordance with the present disclosure may include a shape derived from a segment of a sphere, ovoid, or ellipsoid shape, a vault shape, or the like. In various embodiments and as illustrated in FIGS. 1A-1B, a door 103 may have a shape generally representing a segment of a dome for which opposite sides of the peripheral edges of the segment have been cut by parallel planes, resulting in a modified dome segment having an elongated shape with two parallel, linear edges from a top view. In various embodiments and as illustrated, portions of an outer surface of a bezel portion 101 adjacent to the linear edges of a door 103 may be continuous with or complete the profile of the dome segment and provide a substantially continuous or flush surface area profile between the outer surface of the door and the outer surface of the bezel portion adjacent to the door.

A door 103 may also include various features such as a door pull 116 (as shown, for example, in FIG. 1A). In accordance with various embodiments, a door pull may be a modification of the form or shape of the door at or adjacent to a bottom edge of the door that facilitates operational engagement and actuation of the door by a mating end of a male coupler housing, described in greater detail herein, and may comprise a raised or recessed portion of the door or a projection from or opening in the door. In still other embodiments, the door pull may be a separate component that is attached to the door and serves as a handle, pull, or other feature that may be operationally engaged by a portion of the mating end of a male coupler housing.

In various embodiments, a door may be constructed of a unitary piece of material. In other embodiments, a door may comprise multiple components. For example, a door may comprise multiple fixed or articulating segments, or a door may comprise a single segment that includes additional, separate components for attachment and operational engagement of the door to a receptacle or to a door biasing mechanism.

The generally dome-shaped profile or structure of a door and/or the adjacent areas of a bezel portion may provide for increased structural strength of a receptacle housing and door to external forces that might crack or otherwise compromise the structural integrity of a flat or substantially flat door covering an opening of a comparable size. Likewise, the dome-shape of a door and/or adjacent areas of a bezel portion may also provide for increased resistance of the receptacle to entrance of fluids, dust, dirt, or other environmental contaminants into the coupler module portion of the receptacle housing when the door is in the closed position and prevent such contaminants from accumulating on the surface of the door. For example, a receptacle housing having a dome-shaped door in accordance with various embodiments used in a hospital environment may be resistant to the entrance of various fluids such as bodily fluids, medical fluids, cleaning agents, and the like.

In various embodiments, a door is capable of sliding on a receptacle housing. With continued reference to FIGS. 1A-1B, operation of the door 103 between a closed position (FIG. 1A) in which the opening 104 is concealed by the door and an open position (FIG. 1B) in which the interior of coupler module portion 102 of the receptacle housing is exposed for insertion and mating of a male coupler is achieved by sliding the door 103 along substantially parallel arcuate channels 109 located on either side of the door and configured to slide along opposite edges of the door. The door may include rails 110 located on opposite edges of the door that insert into the channels 109 and guide the sliding operation of the door between the closed position and the open position. In various embodiments, the channels 109 may have an arcuate configuration that is compatible with the arc defined by the profile of the edges of a door and/or the rails thereof. In such embodiments and with additional reference to FIGS. 2B and 3, the channels 109 are configured so that operation of the door along the channels to the open position results in the door 103 being located substantially behind the outer surface of the bezel portion of the receptacle. In various embodiments, the door is substantially hidden from view when in the open position, such as when a male coupler is mated with an assembled receptacle. The position of the door behind the bezel portion of the receptacle may provide for decreased risk of physical damage to the door or of the door interfering with other operations in the vicinity of the receptacle, such as might occur for a door located in an external position when open.

Figure 3:
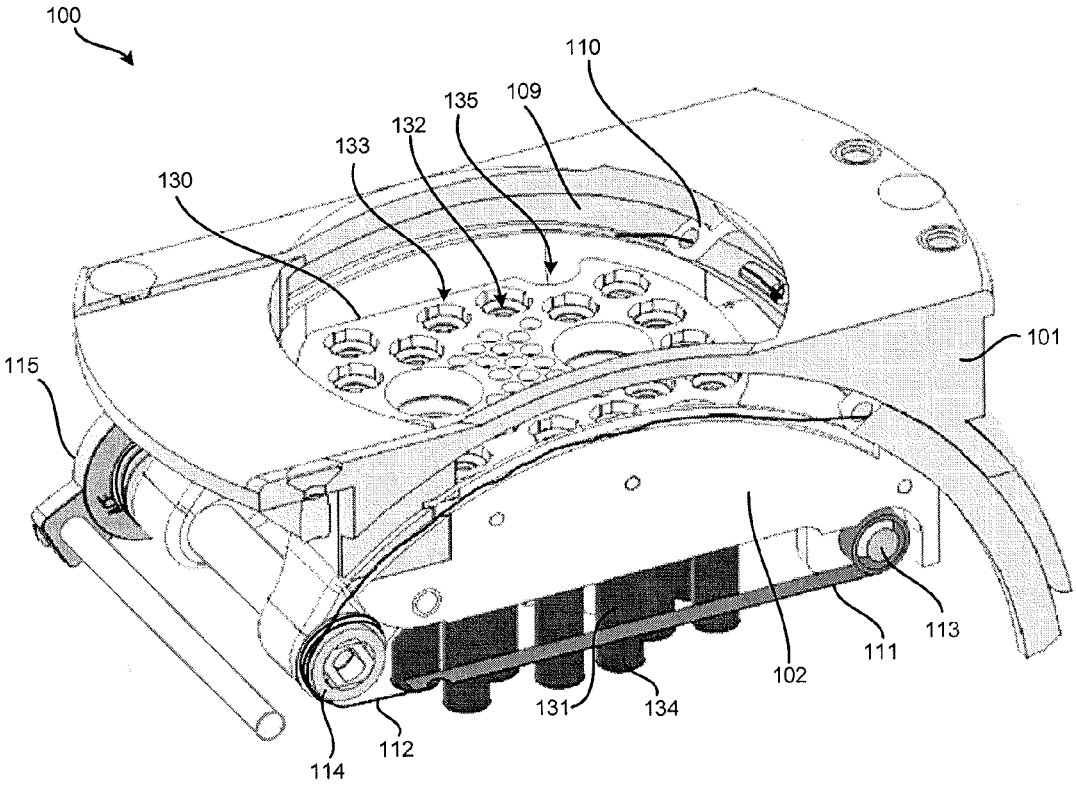
FIG. 3 is a cut-away view of a receptacle housing in accordance with various embodiments.
Figure 4A:
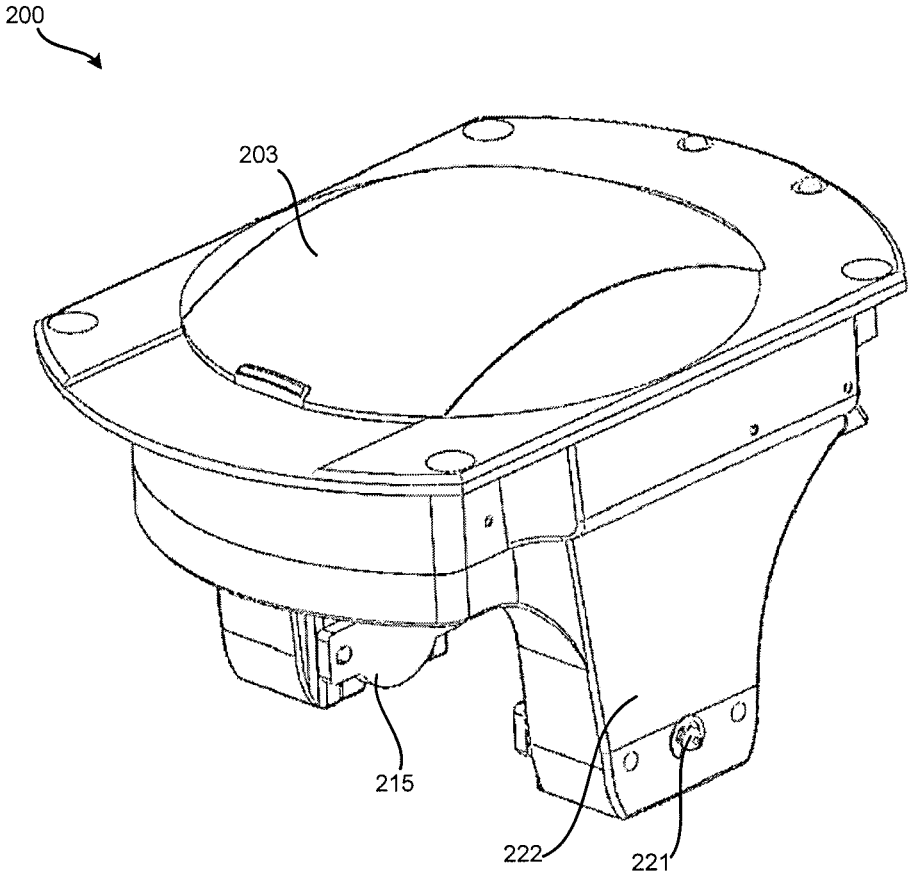
FIG. 4A is a perspective view (from above) of a receptacle housing with a closed door in accordance with various embodiments.
Figure 4B:
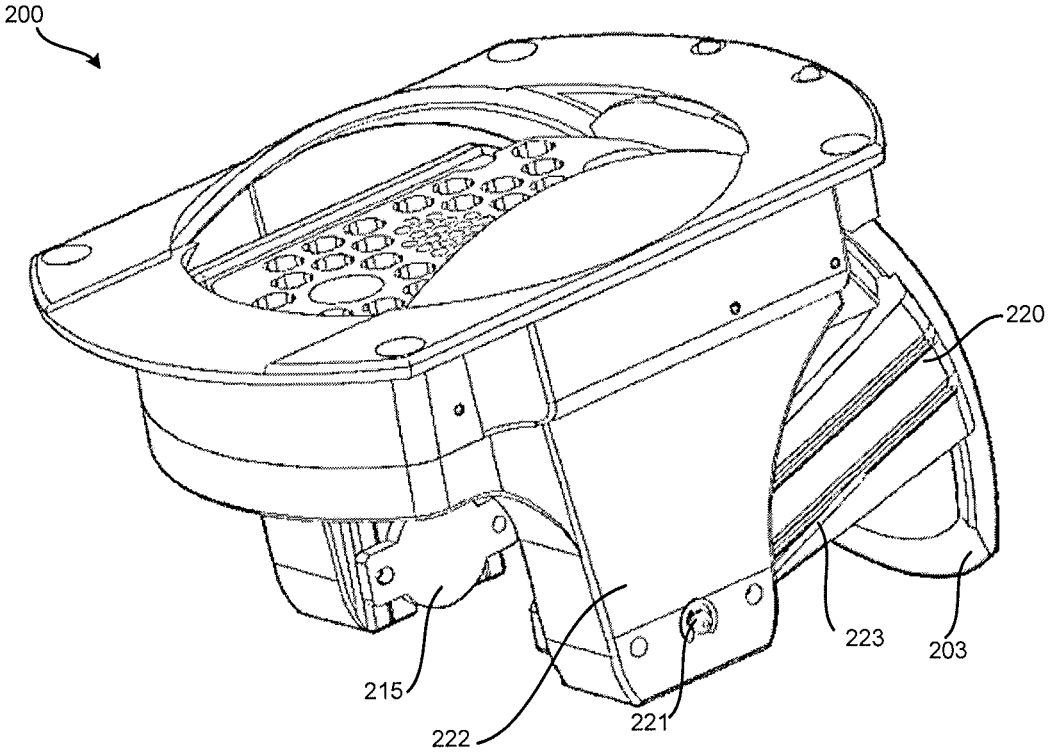
FIG. 4B is a perspective view (from above) of receptacle housing with an open door in accordance with various embodiments.
Figure 5A:
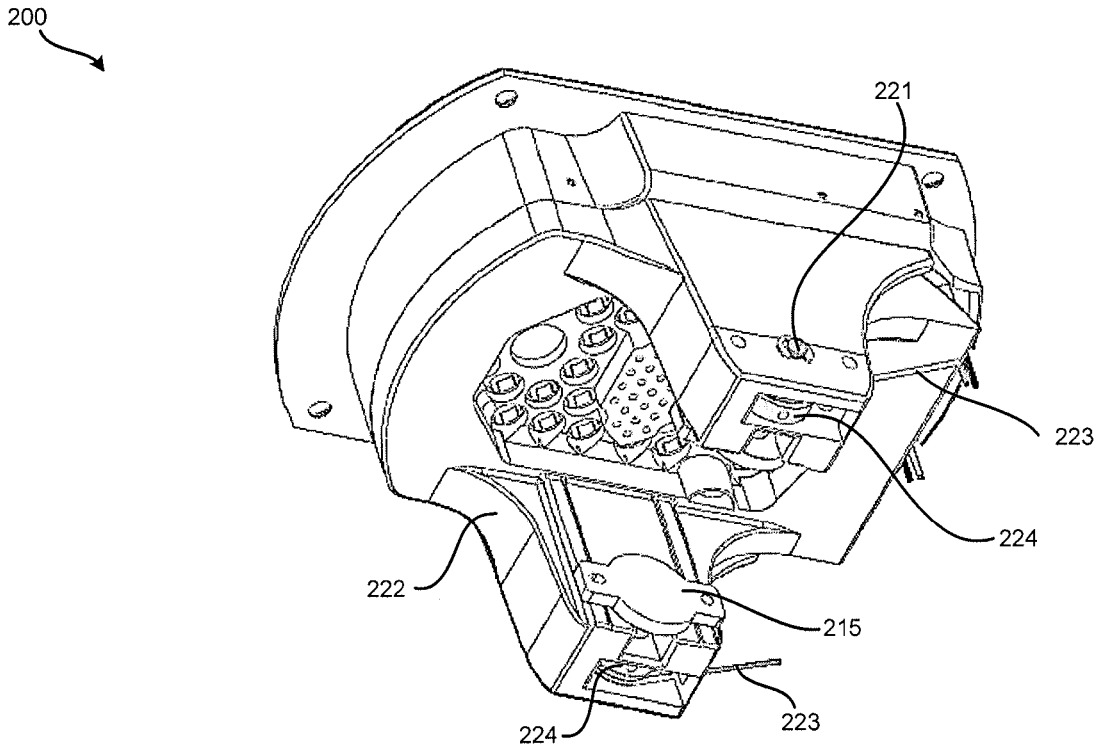
FIG. 5A is a perspective view (from below) of a receptacle housing with a closed door in accordance with various embodiments.
Figure 5B:
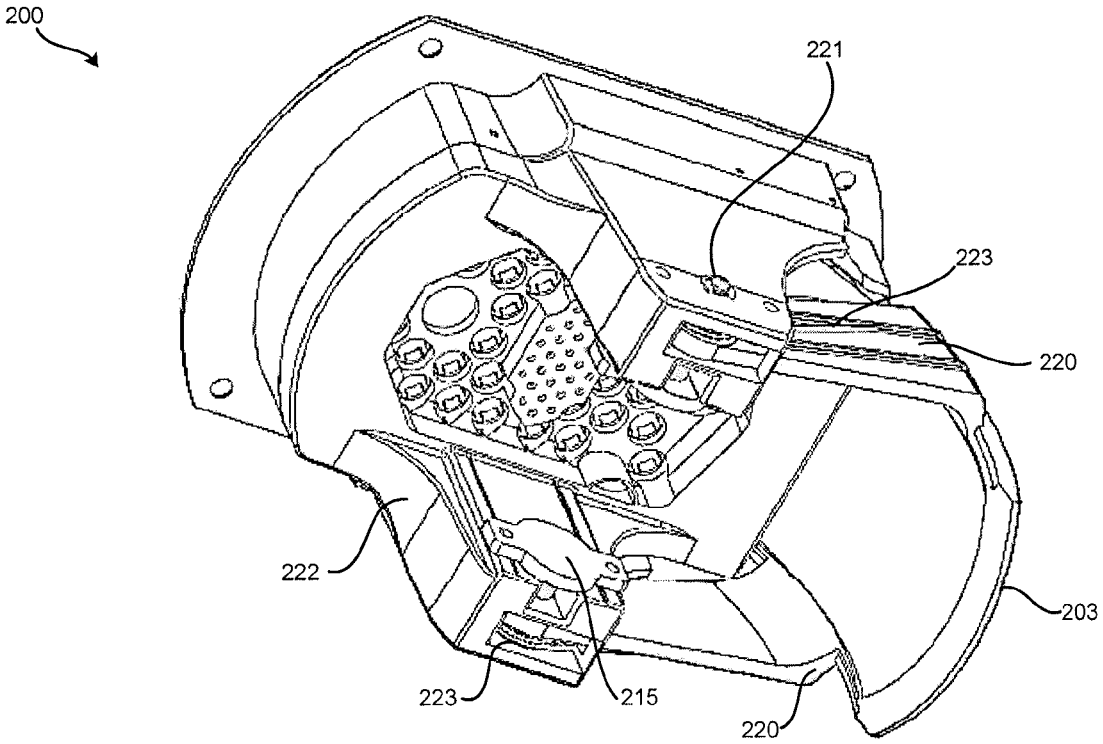
FIG. 5B is a perspective view (from below) of a receptacle housing with an open door in accordance with various embodiments.

With continued reference to FIG. 3, the channels 109 of a receptacle housing 100 may comprise portions of both the bezel portion 101 and the coupler module portion 102, with top edges near either side of the coupler module portion forming lower surfaces of the channels 109, and with the upper and lateral surfaces of the channels being formed by surfaces of the bezel portion 101 oriented away from the outer surface of the receptacle housing (i.e., toward the back of the receptacle housing) and toward the opening defined by the bezel portion. However, channels may be located in or formed by the bezel portion alone, the coupler module portion alone, parts of both portions, or between the bezel and the coupler module portions. Likewise, various other configurations for operation of a door in relation to a receptacle housing, such as configurations in which a door slides or pivots while remaining external to the outer surface of the bezel portion of a receptacle, are within the scope of the present disclosure. Similarly, other configurations of channels or other types of interfaces between a door and a receptacle housing are possible and within the scope of the present disclosure, including, for example, various combinations of slots, pins, rollers, or the like.

A door of a receptacle housing in accordance with various embodiments may be self-closing or biased toward the closed position using a biasing mechanism operationally engaging the door and the receptacle housing. For example, a door may be closed using a biasing mechanism comprising a constant force spring mounted to the receptacle housing and connected to the door via a cable, wire, string, or the like. Operation of the door may cause the spring to unroll, with the restoring force of the spring urging the door to return to the closed position. In other embodiments, other types of springs and/or hinges may be used in a biasing mechanism connected to or located between a door and a portion of the receptacle housing and used to effect closure of a door, including, for example, compression springs, torsion springs, extension springs, wire form springs, living hinges, or the like. Similarly, a biasing mechanism in accordance with various embodiments may employ any of a variety of other mechanical components such as levers, pulleys, gears, and the like.

The receptacle housing illustrated in FIGS. 1A-3 includes a biasing mechanism having a pair of constant force springs 111 connected to the door by fine wires or cables 112. A biasing mechanism spring axel 113 may be connected to the coupler module portion 102 near the back of the receptacle and towards the top end of the receptacle, oriented transversely to the path of travel of the door. The axel may be inserted through holes in the coupler module portion configured to receive and rotationally engage an axel, and the axel may be retained with retaining rings, washers, cotter pins, or the like. Constant force springs 111 may be connected to the axel 113 near either end of the axel, with the springs in a coiled (relaxed) or partially extended configuration when the door is in the closed position. The constant force springs 111 may be connected to the door via cables 112 connected at a first end of each cable to a free end of each spring and connected at a second end of each cable to the door. Each cable may be routed along the back of the receptacle to a pulley assembly 114 connected to the coupler module portion near the back of the receptacle housing towards the bottom end. Each cable may be wrapped around the pulley assembly 114 to operationally engage the pulley assembly and rout from the pulley assembly into the bottom portion of a channel 109 and connected to the door 103 near a bottom corner of the door toward the lateral edge of the door, for example, at a bottom portion of a rail 110. Operation of the door from the closed position to the open position by sliding movement of the door 103 along the channels 109 results in movement of the connected cables 112 and extension of the constant force springs 111 along the bottom of the receptacle housing. The extended constant force springs exert tension on the door via the connecting cables 112, urging the door to return to the closed position. The biasing mechanism may be configured so that the springs continue to exert a closing force on the door when the door is in the closed position to maintain the door in its closed position until the force is overcome by actuation of the door, for example, during a coupler mating operation.

Figure 2A:
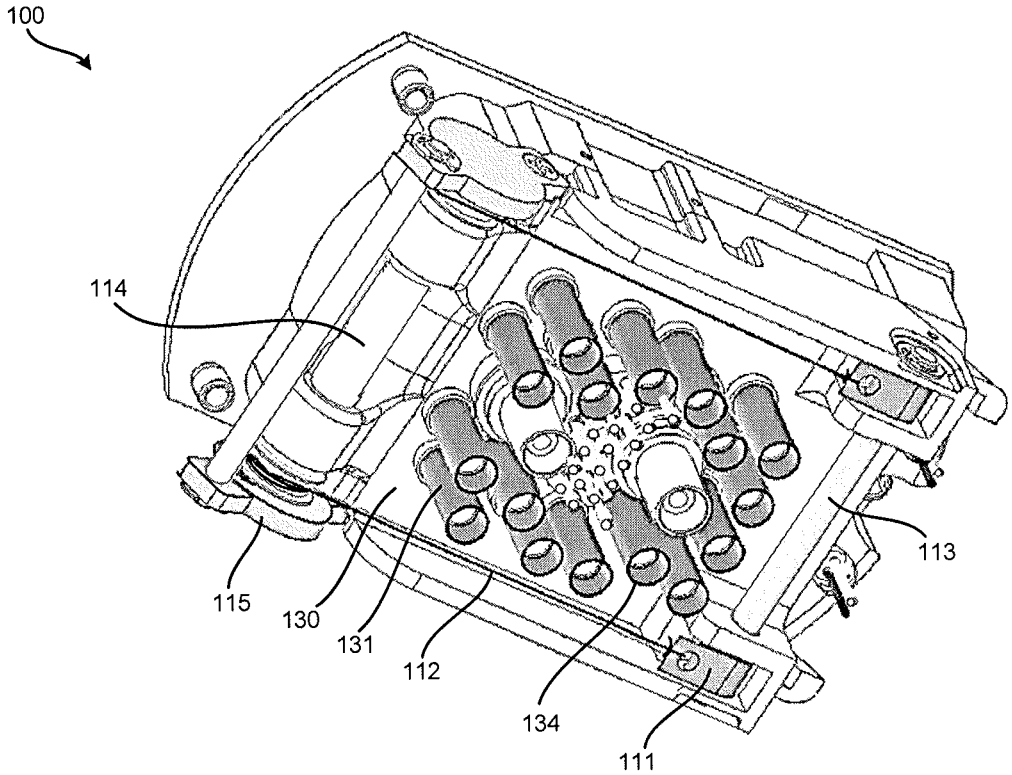
FIG. 2A is a perspective view (from below) of a receptacle housing with a closed door in accordance with various embodiments.
Figure 2B:
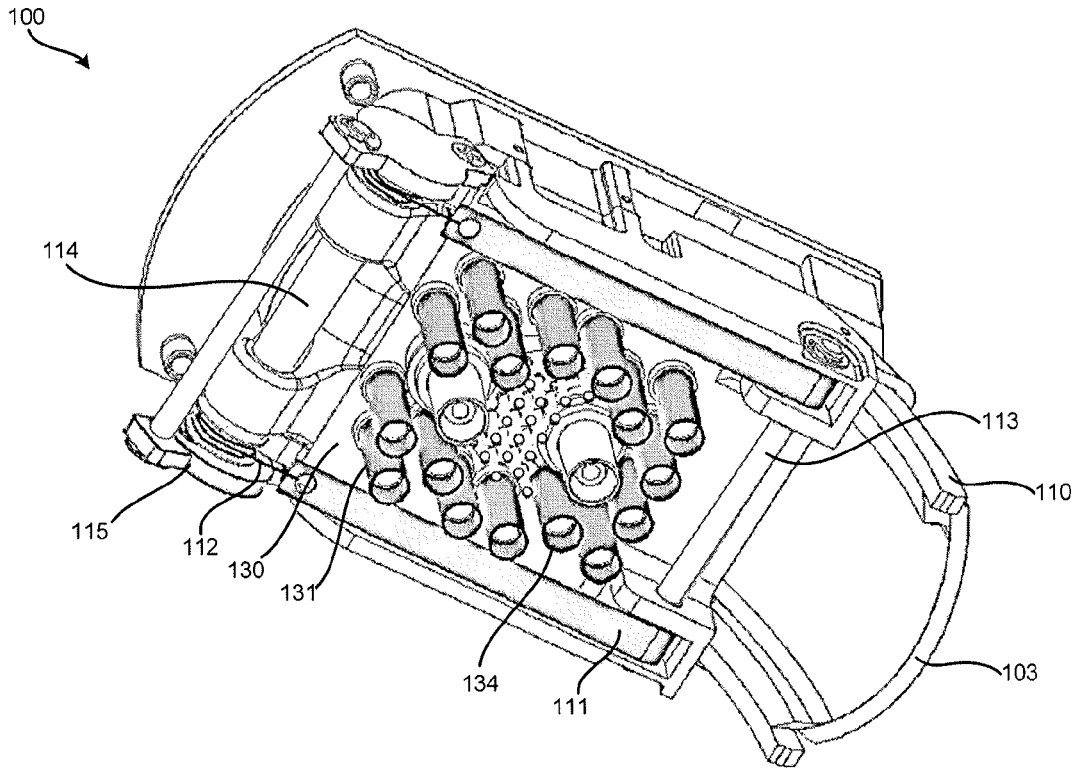
FIG. 2B is a perspective view (from below) of a receptacle housing with an open door in accordance with various embodiments.

In accordance with various embodiments, a receptacle housing configured with a connected door configured to slide on the receptacle housing and a door biasing mechanism as described above may permit the receptacle housing to be used in applications or receiving structures where the installation depth available for the receptacle housing is limiting. For example, the receptacle housing 100 illustrated in FIGS. 1A-3 may be mounted in a receiving structure with an available mounting depth of 50 mm or less. When the door 103 is in the open position, as shown in FIGS. 1B and 2B, the upper edge of the door is located behind the outer surface of the receptacle housing at a vertical depth of approximately 40 mm. The use of a connection allowing the door to slide into a closed or open position eliminates the need for a single fixed pivot point to provide a radius for operation of the door and permits a relatively shallow installation depth.

In an alternative embodiment, illustrated in FIGS. 4A-5B, a receptacle housing may include a door connected to the receptacle housing by a hinge or pivot. The use of a pivoting connection, while possibly requiring a greater installation depth than for a door capable of sliding into an open or a closed position as described above, may provide a mechanically more simple and robust receptacle housing. A receptacle housing 200 with a pivoting door 203 may include many of the same or similar features of a receptacle housing 100 as described above for FIGS. 1A-3. In the illustrated embodiment, a receptacle housing 200 includes a door 203 with a support arm 220 located on each side of the door and extending downwardly from the door to axels 221 that pivotably connect the support arms of the door to a hinge portion 222 of the receptacle housing. The hinge portion 222 may comprise a pair of supporting structures extending from the back of the receptacle housing, such as from the back of the coupler module portion, at or near opposite sides of the receptacle housing, such that the axels 221 connecting the door to the receptacle housing are located approximately opposite a midpoint of the opening of the receptacle housing. In various embodiments, a pivotably connected door may further include door edges that slide or travel within corresponding channels. For example, as illustrated in FIG. 4B, the lateral edges of the door 203 are beveled and travel within a partial channel formed by the bezel portion of the receptacle that overlaps the outer surface of the door. Such a configuration may help to prevent entry of external contaminants into the receptacle housing when the door is in the closed position.

The door and hinge portion may be further configured with a biasing mechanism that urges the door from an open position to a closed position. For example, receptacle housing 200 includes torsion springs 223 mounted on the axels 221 within the hinge portions 222 and connected to the support arms 220 of the door 203. When the door is in the open position, the torsion springs 223 exert a torsional force on the support arms 220, urging the door back to the closed position. In the closed position, the torsion springs continue to exert force on the door to maintain the door in its closed position.

In various embodiments, a door biasing mechanism may also include a damping mechanism to dampen spring-actuated closure of the door. Referring back to FIGS. 1A-3, the receptacle housing 100 includes a damping mechanism 115 connected to the receptacle and operationally engaged to the pulley 114 of the biasing mechanism. In accordance with various embodiments, inclusion of a damping mechanism in the door biasing mechanism may modulate the force with which the door reaches the closed position when a male coupler is removed from the receptacle or the door is otherwise actuated by the biasing mechanism to the closed position. Any suitable type of damping mechanism is within the scope of the present disclosure.

Likewise, the biasing mechanism of a pivotably connected door may also include a damping mechanism. For example and as illustrated in FIGS. 4A-5B, the biasing mechanism of the receptacle housing 200 includes a damping mechanism 215 attached to each axel 221. The support arms 220 of the door 203 may be connected to the axels 221 via a hub 224 or other connection such that the axels rotate with respect to the hinge portion 222 of the receptacle housing and are rotationally fixed to the support arms 220 of the door. A hub may comprise an integral feature of a support arm 220, or the hub may be a separate component to which a support arm may be attached. In either of these alternative embodiments, one end of each axel may operationally engage a damping mechanism 215 connected to the hinge portion 222, while the other end of each axel may be retained within the hinge portion 222 by a retaining ring, retaining washer, cotter pin, or the like.

In accordance with various embodiments, a coupler module portion of a receptacle housing may include a coupler platform configured to hold one or more connectors. For example, a coupler module portion may include a coupler platform that holds a number of electrically conductive contacts such as sockets, pins, or coaxial contacts. In such an embodiment, the coupler platform may be constructed of a dielectric material such as a polymer or plastic that may be molded or machined to a desired shape or configuration. The coupler platform may be configured to hold multiple conductive contacts in any suitable arrangement or configuration relative to one another in a position in an opening of the receptacle housing suitable for mating with a male coupler, as described in greater detail below.

Referring back to FIGS. 1B-3, the illustrated receptacle housing 100 includes a coupler platform 130 configured to hold a plurality of conductive contacts, such as socket contacts 131 of various sizes at fixed positions within the receptacle housing. The socket contacts have a mating end 132 oriented toward the opening 104 defined by the bezel portion of the receptacle, such that the socket contacts may be mated and electrically connected with the corresponding conductive contacts included in a male coupler. The mating end 132 of the socket contacts may be recessed beneath the outer surface of the coupler platform, and the coupler platform may define openings 133 that have a first open end 136 through which conductive contacts of a male coupler pass to make electrical contact with a socket contact 131 and a second open end 137 through which the socket contact 131 electrically connects to one or more electronic components associated with the structure in which the receptacle is located or other remote electronic components. The openings 133 may have various sizes or configurations that facilitate mating or engagement of a corresponding conductive contact of a male coupler. For example, an opening 133 may be oversized, beveled, keyed, or the like. The socket contacts 131 included in the coupler module portion also have a second end 134 located opposite the mating end 132. The second end 134 of the socket contacts 131 may be located at the back of the coupler module portion of the receptacle housing and be used for electrical connection of the receptacle housing and the connectors housed therein to one or more electronic components associated with the structure in which the receptacle is located or other remote electronic components, for example, via wires or leads connected to the second end 134 of each socket contact 131 and electrically connecting remote electronic devices.

In accordance with various other embodiments, the coupler module portion of a receptacle housing may include a coupler platform configured to hold connectors other than conductive contacts. For example, a coupler platform of a receptacle housing may be configured to accept or retain any of a variety of connector types in a configuration suitable for mating corresponding connectors of a male coupler, including, for example, optical fiber connectors or hydraulic, pneumatic, or vacuum fittings or connectors. Similarly, the coupler platform of a receptacle housing may be configured to accept or retain various types of connectors within the same assembled receptacle, such that the receptacle housing may be used as a part of a multi-coupling system wherein one coupling system may be used to simultaneously establish or discontinue, for example electrical, optical, and hydraulic interconnections between two or more devices upon mating or unmating of the coupling system.

A coupler platform may include one or more keying slots formed in the coupler platform. A keying slot 135 formed in a peripheral surface of the coupler platform 130 of a receptacle housing 100 is illustrated in FIGS. 1B and 3. A second keying slot (not shown) the same as or similar to the first is located on an opposite side of the coupler platform 130. The keying slots facilitate alignment and mating of the receptacle housing with a corresponding male coupler in only one particular predetermined orientation. Likewise, the peripheral surface of coupler platform 130 may define a particular shape or outline configured to be received within an opening of a mating end of a male coupler, thereby only allowing insertion and mating of the mating end of a corresponding male coupler in a single orientation. Thus, a user cannot inadvertently insert or mate an improperly configured or incompatible male coupler. The safety and reliability of a coupling system can thereby be heightened by providing for error-proof connections between various remote devices wherein the assembled receptacle and male coupler cannot be misconnected. In alternative embodiments, any type of keying element may be used and in greater or fewer numbers than the two keying slots of the receptacle housing 100 illustrated. For example, an alternative embodiment may utilize a single protrusion positioned at a peripheral edge of the coupler platform 130 rather than a plurality of keying slots.

A coupling system in accordance with various embodiments includes a receptacle housing as described above as well as a corresponding male coupler housing compatible with the receptacle housing and used to complete one or more connections between an assembled receptacle and an assembled male coupler and one or more remote devices connected to each. Male coupler housings in accordance with various embodiments are described in detail below. FIGS. 6A-7B illustrate male coupler housings in accordance with various embodiments. Conductive contacts are shown in FIGS. 6A-7B to illustrate male coupler housings in accordance with various embodiments that are partially assembled to contain electrical connectors in the coupler platform. However, the coupler platform of a male coupler housing may be configured to accept or retain any of a variety of connectors, including, for example, hydraulic, pneumatic, or vacuum fittings or connectors or optical fiber connectors. Similarly, the coupler platform of a male coupler housing may be configured to accept or retain various types of connectors within the same assembled male coupler, such that the male coupler housing may be used as a part of a multi-coupling system wherein a single coupling system may be used to simultaneously establish or discontinue, for example, electrical, optical, and hydraulic interconnections between two or more devices upon mating or unmating of the coupling system.

Figure 6A:
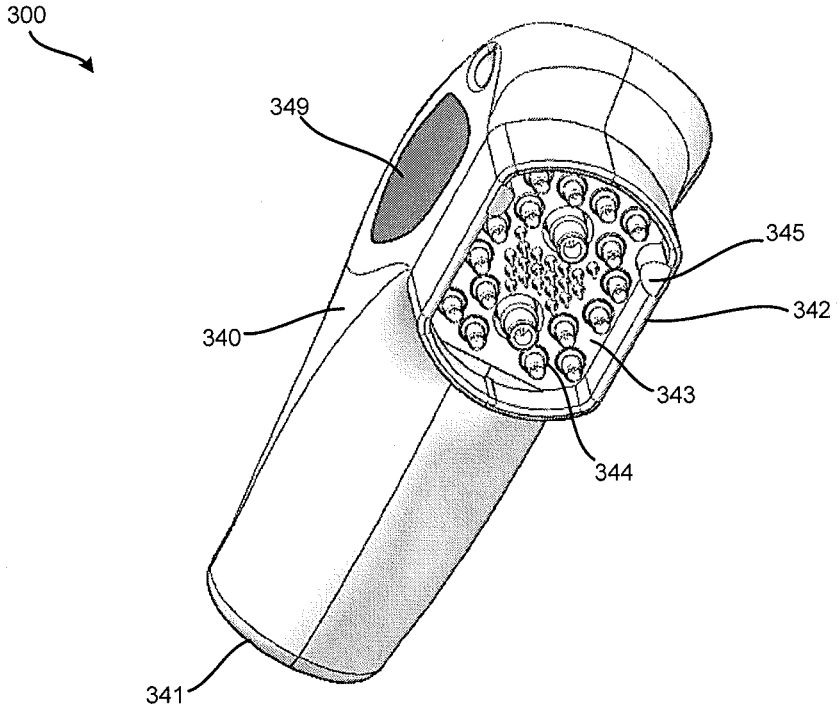
FIG. 6A is a perspective view (from below) of a male coupler housing in accordance with various embodiments.
Figure 6B:
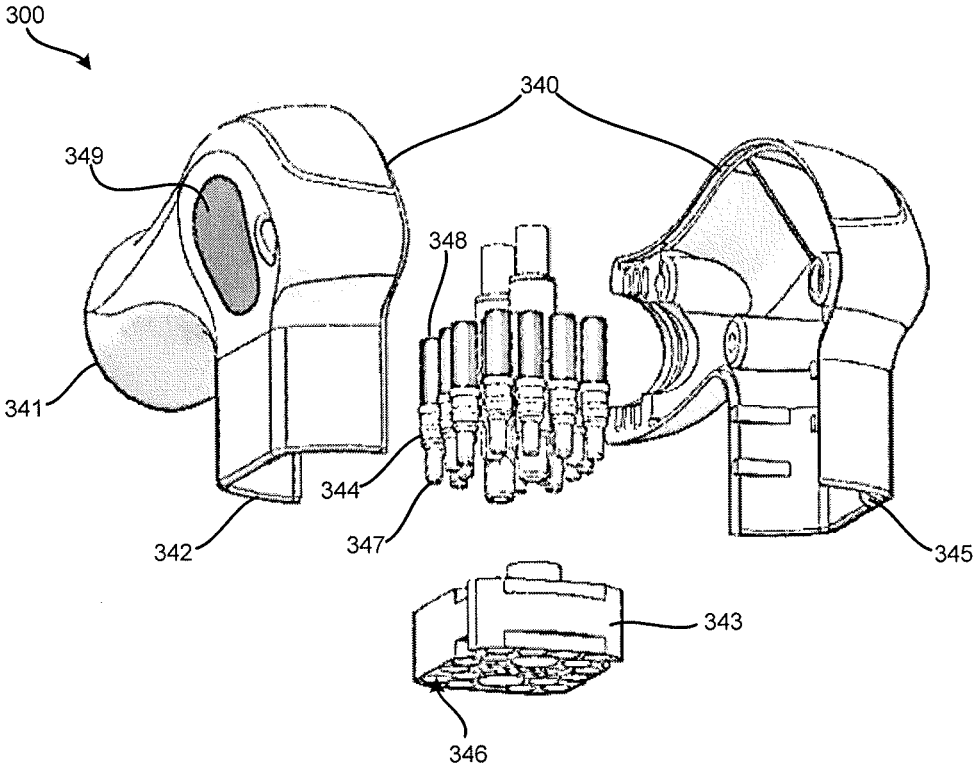
FIG. 6B is an exploded view of a male coupler housing in accordance with various embodiments.

FIGS. 6A-6B show a perspective view and an exploded view of a male coupler housing 300 in accordance with various embodiments. The male coupler housing 300 includes a shell 340 defining a cavity that serves to house or enclose connectors such as the illustrated conductive contacts as well as a portion of the associated wires, leads, or cables. The shell can also serve as a handle by which a user may grasp and operate the male coupler. The shell 340 of the male coupler may have a pistol-grip shape that can be conveniently grasped and manipulated with one hand. The shell may be configured with an elongated body portion having a tail end 341 and a mating portion extending approximately orthogonally from the elongated body portion, with the mating portion having a mating end 342 defining a plane that is approximately parallel to the axis of the elongated body of the shell. The mating portion of the shell may be configured to secure a male coupler housing coupler platform 343 and to define an opening whereby conductive contacts 344 retained by the male coupler housing coupler platform in the illustrated, partially assembled male coupler may be mated to the corresponding conductive contacts of an assembled receptacle. The mating portion of the shell may be configured to secure the male coupler housing coupler platform in an orientation substantially parallel to the elongated body portion of the shell and/or to the plane defined by the mating end. The mating end may also have a shape and/or include key elements 345 that ensure proper compatibility and alignment of an assembled male coupler with an assembled receptacle during a mating process by preventing inadvertent mating of an improperly matched male coupler and receptacle. The shell may also define an opening at the tail end that permits, for example, one or more leads, wires, cables or the like (not shown) connected to the lead end of the conductive contacts in the coupler module to extend from an assembled male coupler to electrically connect the male coupler to remote devices, sensors, or the like. In various other embodiments, an opening at the tail end of a male coupler housing shell may be used to permit other types of conduit such as hoses, tubing, fiber optic cable, or the like to extend from a male coupler that comprises connectors other than electrically conductive contacts.

The shell 340 of a male coupler housing may include multiple components such as the two halves of the shell shown in FIG. 6B. Shell components may be removably joined using screws, bolts, or other fasteners. In other embodiments, shell components may be joined using a snap-fit connection, spring clips or tabs, or the like. In still other embodiments, shell components may be permanently joined, for example, using adhesives or by welding. A male coupler housing shell may include various additional internal features such as ribs, slots, or grooves that facilitate connection of a cable sheath to the tail end of the housing. A shell may also include other components such as grip inserts 349 or other features that may enhance the ergonomics, safety, or usability of an assembled male coupler. A shell comprising any number of separate components joined using any suitable means is within the scope of the present disclosure.

A coupler platform of a male coupler housing may be configured to secure one or more connectors for mating with the connectors of a receptacle. For example, a male coupler housing 300 may include a coupler platform 343 configured to secure connectors such as the illustrated conductive contacts 344 in an assembled male coupler in a manner suitable for making one or more electrical connections with a corresponding receptacle when the mating end 342 of the male coupler is inserted into the receptacle. The coupler platform may comprise a molded or machined piece of material configured to receive one or more connectors such as the conductive contacts illustrated and to secure them in predetermined positions and orientations relative to one another in a mating end of a male coupler housing such that they may be inserted into and electrically connected with the corresponding conductive contacts in an assembled receptacle when the male coupler is mated with the receptacle. The coupler platform may be constructed, for example, of a non-conductive material such as a plastic and include a fastening mechanism that secures (e.g., by an adhesive or an interference fit) the conductive contacts in a desired orientation or configuration. In addition, the coupler platform also includes a securing mechanism for rigidly securing the coupler platform with the shell of the male coupler housing, for example, by an interlocking system of ledges and channels configured in the shell and the coupler platform.

A coupler platform of a male coupler housing in accordance with various embodiments may include one or more ports for insertion and retention of connectors that may be included in the assembled male coupler. For example, the coupler platform 343 of the illustrated male coupler housing 300 includes a plurality of ports 346 for insertion and retention of conductive contacts 344. The ports 346 may be of various shapes or sizes in order to accommodate conductive contacts 344 of varying shapes or sizes. The conductive contacts 344 may snap into the ports 346 and thus be secured with the coupler platform 343 by an interference fit. Alternatively, the conductive contacts may be fastened within the ports via other methods, for example by adhesives. Each of the conductive contacts 344 may include a mating end 347 and a lead end 348. The mating end 347 may be used for attachment to and creation of an electrically conductive connection with a mating end 132 (FIG. 3) of a receptacle conductive contact, and the lead end 348 may be connected to a wire or lead that may extend to a remote electronic device.

Figure 7A:
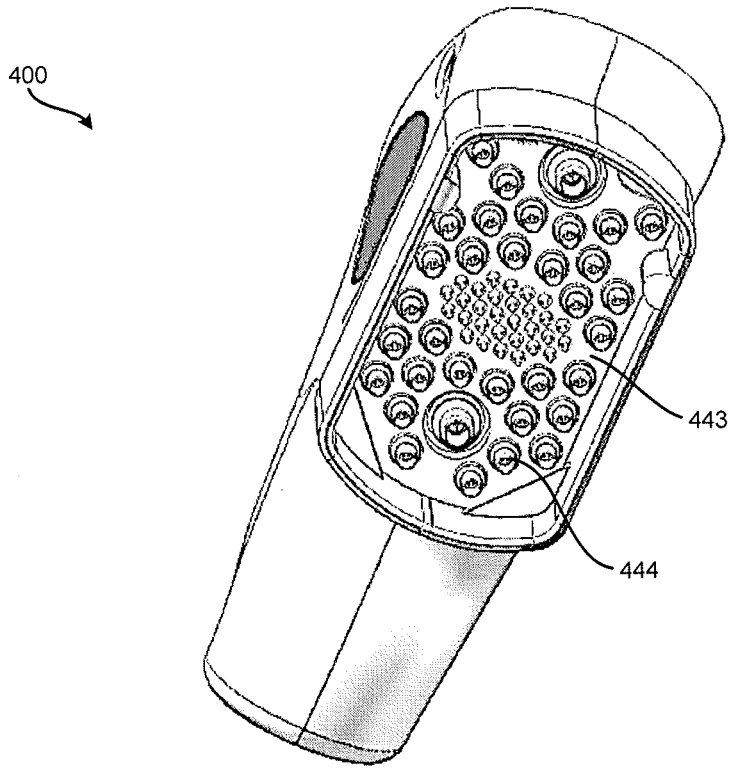
FIG. 7A is a perspective view (from below) of a male coupler housing in accordance with various embodiments.
Figure 7B:
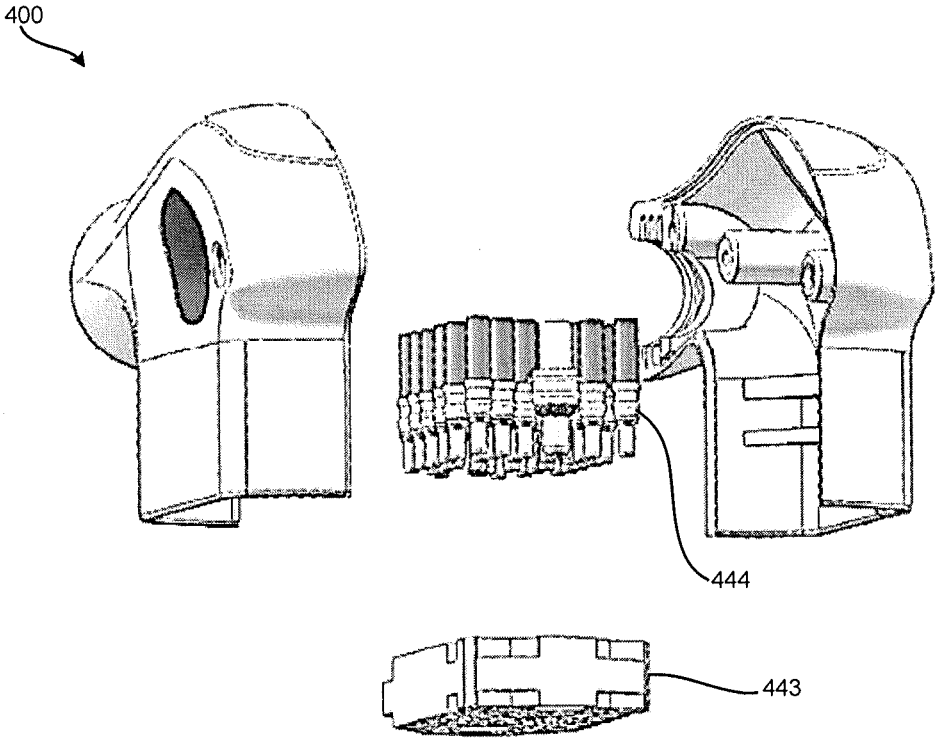
FIG. 7B is an exploded view of a male coupler housing in accordance with various embodiments.

The conductive contacts included in a male coupler configured for making electrical connections may include pins, sockets, coaxial conductive contacts, or the like in any suitable combination of sizes or configurations. The male coupler housing 300 illustrated in FIGS. 6A-6B is a partially assembled 38 contact male coupler comprising a total of 18 coaxial contacts of two different sizes as well as 20 smaller pin contacts located in a central portion of the coupler platform. FIGS. 7A-7B illustrates a larger male coupler housing 400 in accordance with an alternative embodiment. Male coupler housing 400 may include the same or similar features as described and illustrated for male coupler housing 300, but is configured with a larger coupler platform 443 that can accommodate a larger number of conductive contacts 444 such as the 64 conductive contacts in the illustrated embodiment, which include 32 smaller coaxial contacts and two larger coaxial contacts in addition to 30 small pin contacts. In accordance with various embodiments, the size and configuration of a male coupler housing, including the shell and the coupler platform, as well as the sizes, types, and configurations of the conductive contacts arrayed in the coupler platform, may be arranged in any suitable configuration to provide the desired number of contacts having the desired electrical specifications. Likewise, although the illustrated male couplers includes male pin and coaxial conductive contacts that protrude from the coupler platform and are received by a corresponding conductive contact in the receptacle, male couplers having pin, socket, or coaxial conductive contacts in any configuration with respect to the coupler platform are within the scope of the present disclosure.

Furthermore, as for the coupler platform of a receptacle housing described above, the coupler platform of a male coupler housing is not limited to configurations that can hold conductive contacts as illustrated in the embodiments shown in FIGS. 6A-7B, but may be configured to hold other types of connectors in accordance with various embodiments. For example, the coupler platform of a male coupler housing may be configured to accept or retain any of a variety of connector types, including, for example, hydraulic, pneumatic, or vacuum fittings or connectors or optical fiber connectors. Similarly, the coupler platform of a male coupler housing may be configured to accept or retain various types of connectors within the same assembled male coupler, such that the male coupler housing may be used as a part of a multi-coupling system wherein one coupling system may be used to simultaneously establish or discontinue, for example electrical, optical, and hydraulic interconnections between two or more devices upon mating or unmating of the coupling system.

Referring now to FIGS. 8-11, perspective views of a receptacle housing 100 mounted in a receiving structure 500 are shown to at various stages of a coupling system mating process to illustrate the mating process of a coupling system in accordance with various embodiments. The receptacle housing 100 shown in FIGS. 8-11 may be the same as or similar to the receptacle housing 100 illustrated in FIGS. 1A-3, and the male coupler housing 300 may be the same as or similar to the male coupler housing 300 of FIGS. 6A-6B. For purposes of describing a coupling system mating process with reference to FIGS. 8-11, the receptacle housing 100 and the male coupler housing 300 will be referred to as if they were an assembled receptacle and male coupler.

Figure 8:
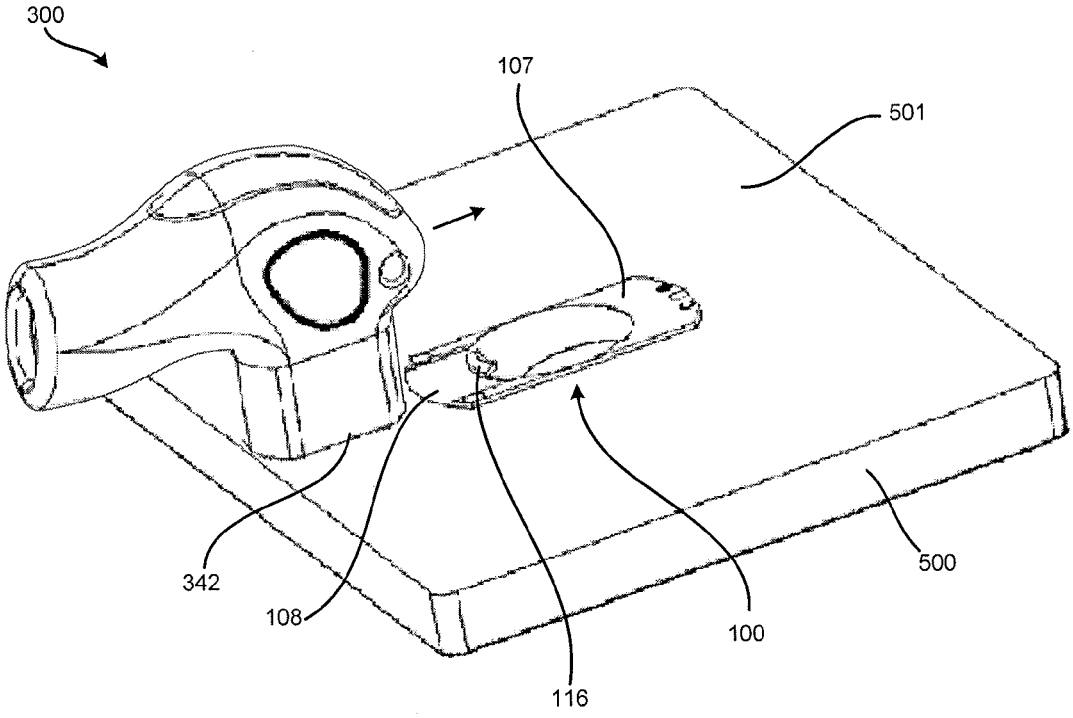
FIGS. 8-11 are perspective views of a mating process of a male coupler and a receptacle in accordance with various embodiments.

As shown in FIG. 8, the mating end 342 of a male coupler 300 may be brought into contact with an outer surface 501 of a receiving structure 500 at or near the bottom peripheral edge of a receptacle 100. The mating end 342 of the male coupler is moved by the user in a sliding fashion along the surface 501 in the direction of the runway 108 comprising a recessed region in the primary field 107 of the outer surface of the bezel of the receptacle. The raised configuration of the primary field 107 of the bezel in relation to the runway 108 may interrupt the sliding motion of the mating end 342 of the male coupler in locations at the peripheral edge of the bezel other than runway 108 and/or provide tactile feedback to the user as to the location of the receptacle 100 and/or the runway 108.

Figure 9:
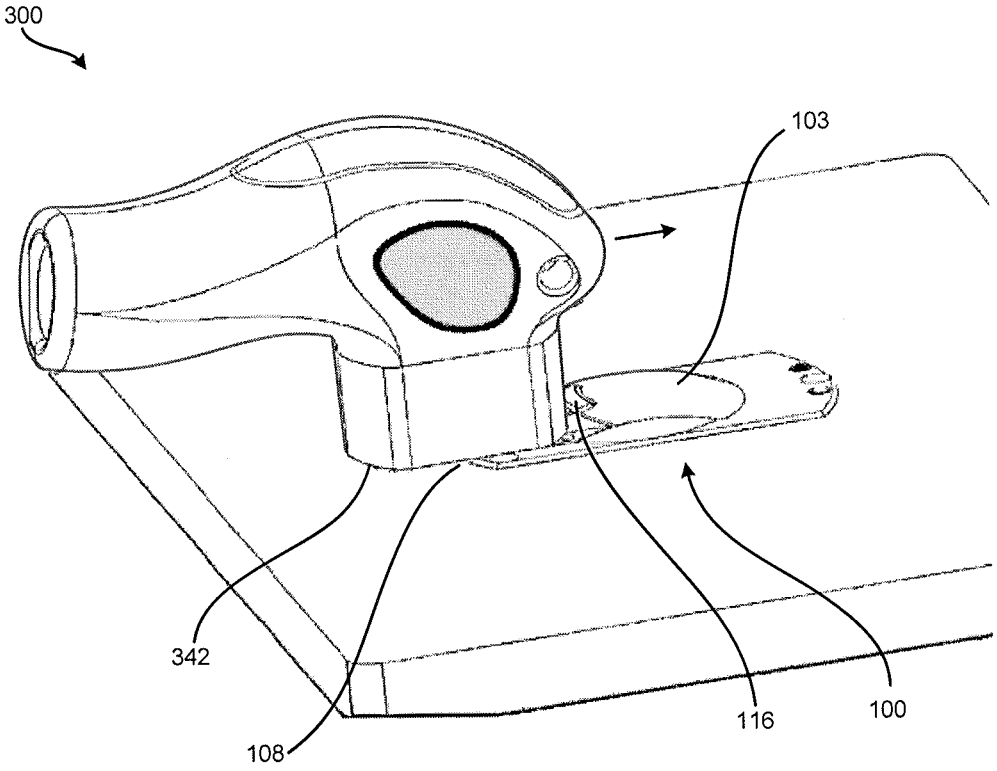

The configuration of the surface of the runway 108 flush with the outer surface 501 of the receiving structure, and the corresponding width of the runway 108 and the mating end 342 of the male coupler permit the user to slide the mating end 342 into the runway 108, with the runway guiding sliding movement of the mating end of the male coupler from an unaligned position toward the opening of the receptacle, as illustrated in FIG. 9. As the mating end of the male coupler comes into contact with the bottom edge of the door 103 of the receptacle, the male coupler may engage the door, for example, via a door pull 116 at or near the bottom edge of the door 103 that may be configured to receive or otherwise engage a portion of the outer surface of the male coupler at the mating end 342. In various alternative embodiments, the outer surface of a male coupler at or near the mating end may include a feature configured to operationally engage a corresponding door pull or other feature of the door.

With continued reference to FIG. 9, movement of the male coupler 300 in the direction indicated by the arrow following engagement of the mating end 342 with the door 103 actuates operation of the door from the closed position toward the open position. As the door 103 is opened by the male coupler 300, the receptacle housing coupler platform holding the connectors enclosed by receptacle housing is exposed.

Figure 10:
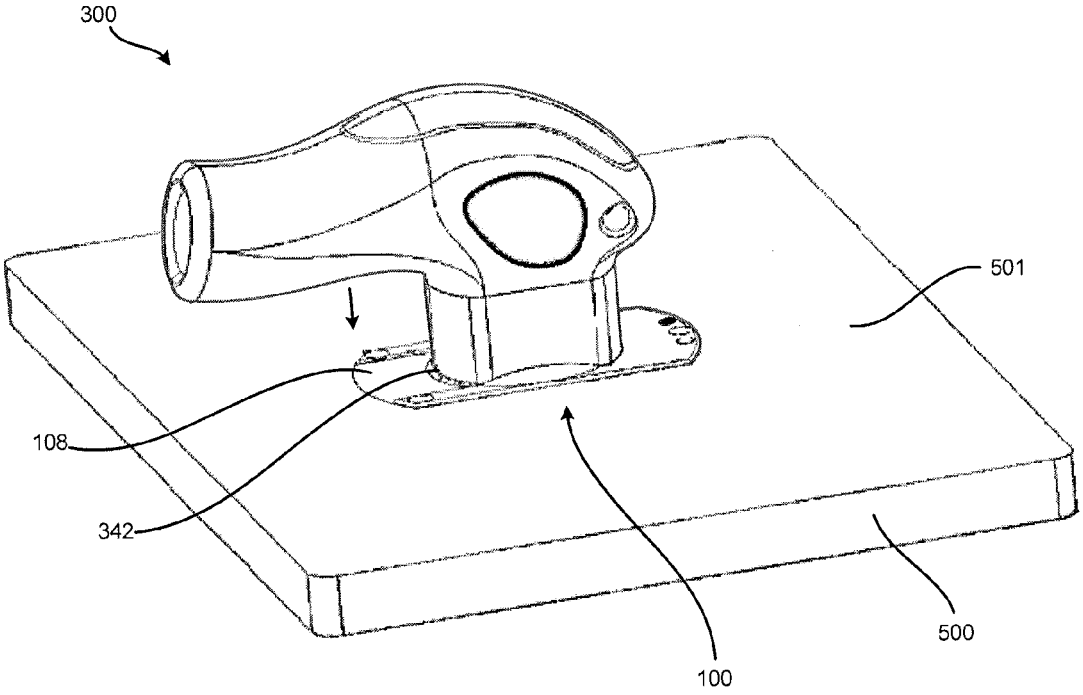

Referring now to FIG. 10, as the male coupler 300 reaches the end of the runway 108, the door approaches the open position and the opening in the bezel of the receptacle 100 is fully exposed by the mating end 342 of the male coupler. In various embodiments, the door is retracted behind the outer surface of the bezel portion of the receptacle when in the open position. Further sliding movement of the male coupler is stopped or prohibited by the door upon reaching the open position and/or by the bezel portion defining the upper aspect of the opening in the bezel portion. In this position, the mating end 342 of the male coupler 300 is substantially positioned and aligned for insertion into the receptacle in a direction substantially perpendicular to the plane of the outer surface 501 of the receiving structure 500, as indicated by the arrow in the figure. As described above, proper compatibility, orientation, and alignment of a male coupler 300 with a receptacle 100 may be ensured by the size and shape of the mating end of the male coupler, the size and shape of the opening in the bezel portion of the receptacle, the presence of key elements and corresponding keying slots in a mating end and a coupler platform, the configuration, orientation, alignment, and compatibility of the corresponding connectors contained within the assembled receptacle and male coupler, or any combination of the foregoing.

Figure 11:
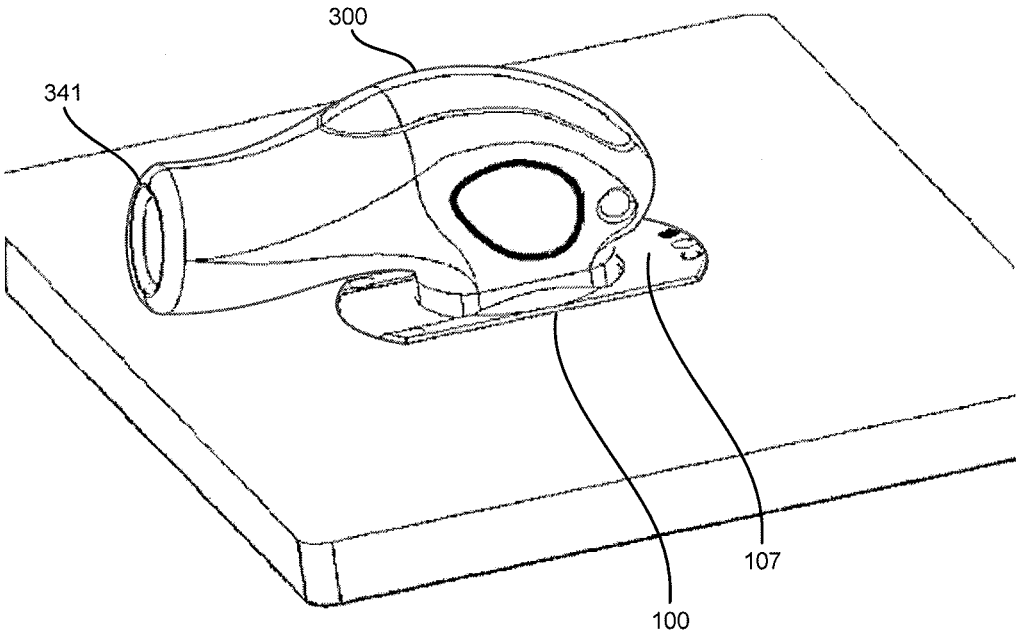
Figure 12:
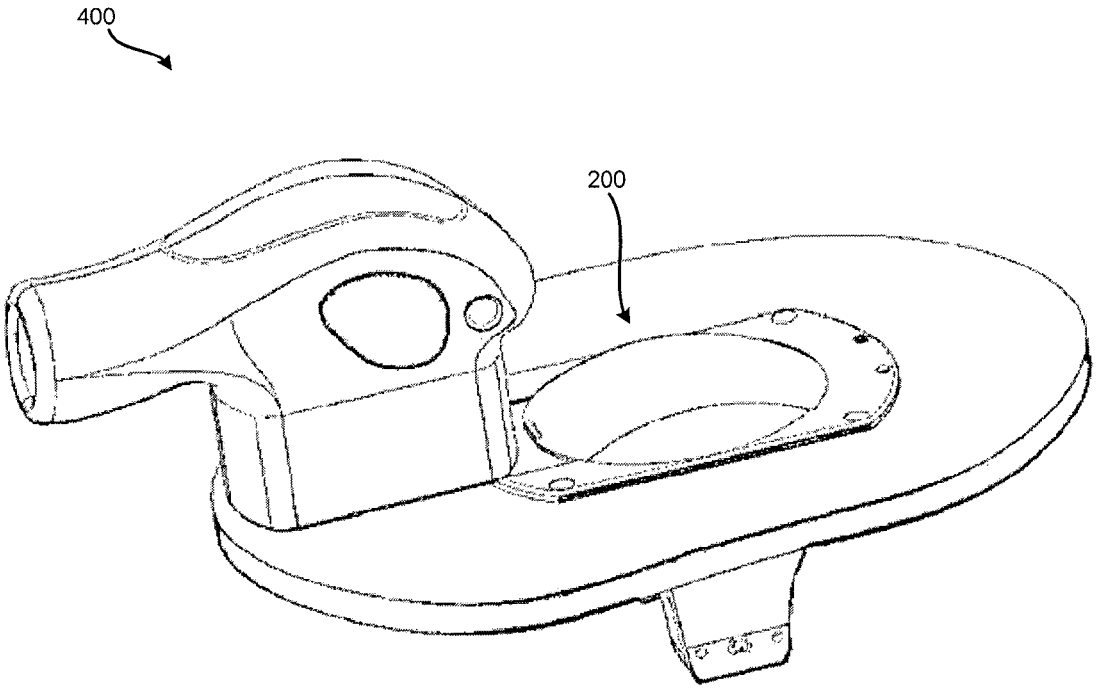
FIGS. 12-15 are perspective views of a mating process of a male coupler and a receptacle in accordance with various embodiments.
Figure 13:
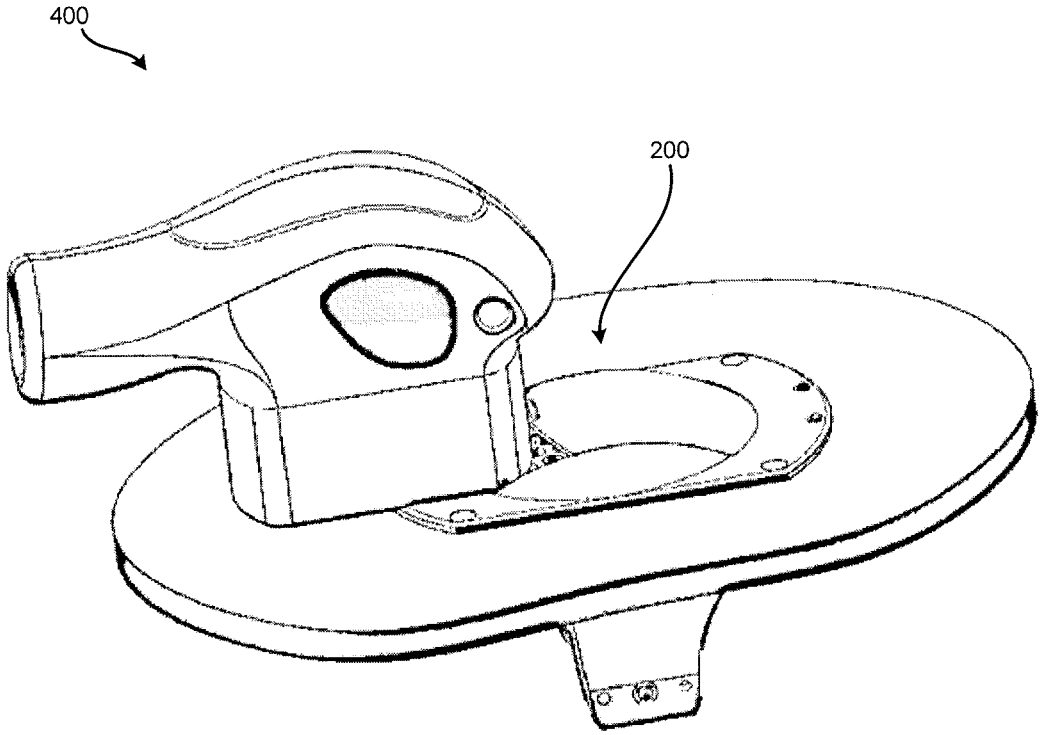
Figure 14:
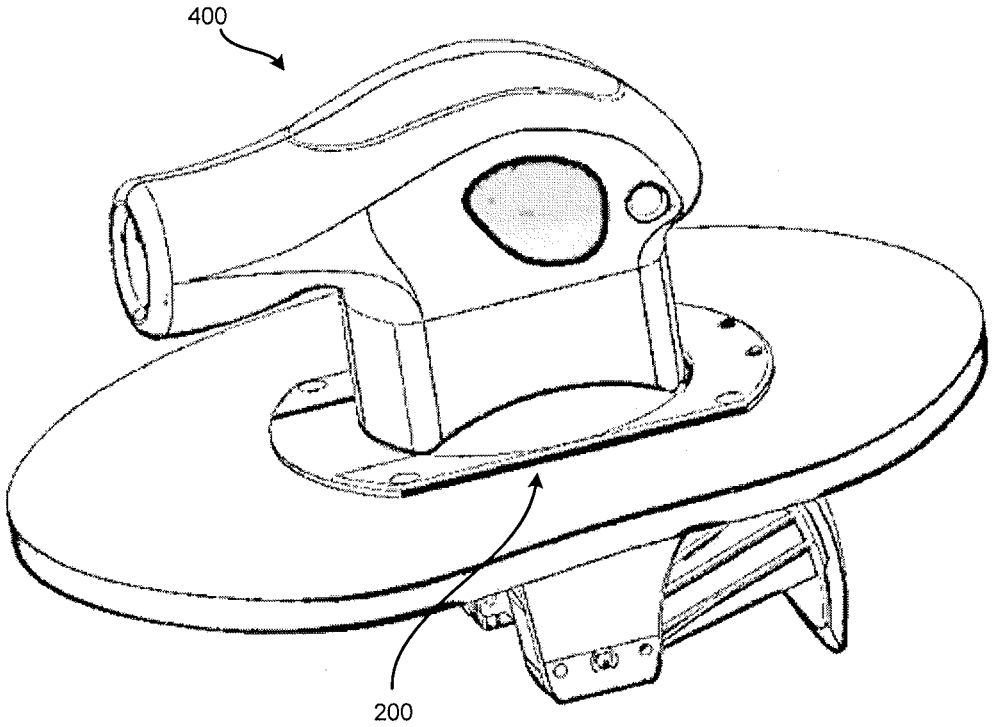
Figure 15:
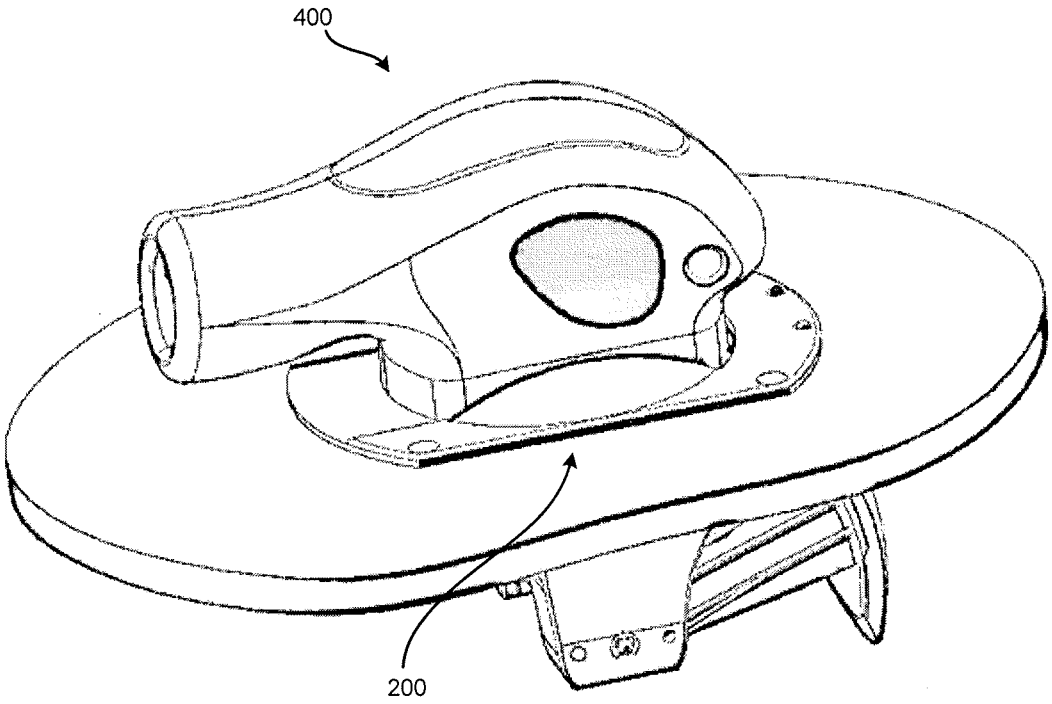

FIG. 11 illustrates a male coupler and receptacle at the completion of a mating process. The male coupler 300 is fully inserted into the receptacle 100. When mating of the male coupler 300 and the receptacle 100 is complete, one or more of the connectors disposed in each will establish a conductive pathway between the male coupler and the receptacle and the remote devices that may be connected to each. For example, remote electrical devices such as sensors, pickups, or the like may be electrically connected to the male coupler 300 via one or more conductive wires or leads (not shown) extending from conductive contacts that may be included in a male coupler outward through the opening at the tail end 341 of the male coupler. Likewise, remote electrical devices such as computers, monitors, or the like may be electrically connected to the receptacle via one or more conductive wires or leads attached to the conductive contacts that may be included in a receptacle and extend to one or more remote devices. Thus, two or more remote electrical devices may be electrically connected by mating a male coupler 300 with a corresponding receptacle 100.

A mating process for a receptacle having a pivotably connected door is likewise illustrated in FIGS. 12-15. The receptacle housing 200 may be the same as or similar to the receptacle housing 200 illustrated in FIGS. 4A-5B, and the male coupler housing 400 may be the same as or similar to the male coupler housing 400 of FIGS. 7A-7B. Likewise, the mating process for a receptacle 200 with a pivotably connected door and a male coupler 400 may be the same as or similar to the mating process described above with respect to FIGS. 8-11.

As used herein, the term "remote device" is used to refer to a device that is located external to a coupling system component and is connected to a coupling system component via a lead, wire, cable, hose, tube, or other conduit. A remote device may include any type of device, including but not limited to a connector, sensor, monitor, computer, pump, or the like.

Various embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

The invention claimed is:

1. A receptacle housing comprising:

a bezel portion comprising an opening configured to receive a male coupler;

a coupler portion connected to the bezel portion and including a coupler platform defining one or more connector openings and also is configured to hold one or more socket contacts, the one or more connector openings having a first open end oriented towards the opening and a second open end, the one or more connector openings configured to facilitate electrical connection of one or more conductive contacts of the male coupler that pass through the one or more connector openings to connect to the one or more socket contacts;

a door moveably connected to the receptacle housing, movable between an open position and a closed position, and configured to conceal the opening in the closed position; and a door control assembly connected to the door and to the receptacle housing and configured to move the door into the closed position.

2. The receptacle housing of claim 1, wherein the door control assembly is a door biasing assembly configured to automatically bias the door into the closed position.

3. The receptacle housing of claim 1, wherein the door includes rails located on opposite edges of the door that insert into channels of the receptacle housing to guide a sliding operation of the door between the open position and the closed position.

4. The receptacle housing of claim 1, wherein the door control assembly includes a constant force spring and a pulley, the constant force spring and the pulley being configured to automatically guide the door into the closed position.

5. The receptacle housing of claim 1, wherein the door is pivotably connected to the receptacle housing.

6. The receptacle housing of claim 2, wherein the door biasing assembly includes a torsion spring.

7. The receptacle housing of claim 1, wherein the door includes a dome-shaped portion.

8. The receptacle housing of claim 1, further comprising substantially parallel channels configured to slide along opposite edges of the door.

9. The receptacle housing of claim 1, wherein the door includes a door pull at a bottom edge of the door for engaging a portion of a mating end of the male coupler.

10. The receptacle housing of claim 1, wherein the bezel portion comprises an outer surface of the bezel portion that is raised at a peripheral edge relative to a surrounding surface in which the receptacle housing is mounted.

11. The receptacle housing of claim 10, wherein the bezel portion further comprises a runway configured to receive a mating end of the male coupler and guide the mating end of the male coupler from an unaligned position outside of a peripheral edge of the bezel portion to an aligned position at the opening, wherein the runway has a recessed surface that is substantially flush with the surrounding surface.

12. A coupling system comprising:

a male coupler housing having:

a shell including:

a body portion having:

a tail end, a mating end, and a mating portion positioned proximate to the mating end and having an opening for connecting a conductive contact of a male coupler to a female coupler, and a housing coupler platform for the male coupler, the housing coupler platform being secured to the mating portion; and a female coupler housing having:

a bezel portion comprising an opening configured to receive the male coupler, a coupler portion connected to the bezel portion and including a coupler platform defining one or more connector openings and also is configured to hold one or more socket contacts, the one or more connector openings having a first open end oriented towards the opening and a second open end the one or more connector openings configured to facilitate electrical connection of one or more conductive contacts of the male coupler that pass through the one or more connector openings to connect to the one or more socket contacts, a door moveably connected to the female coupler housing, movable between an open position and a closed position, and configured to conceal the opening in the closed position, and a door control assembly connected to the door and to the female coupler housing and configured to move the door into the closed position.

13. The coupling system of claim 12, wherein the door control assembly is configured to automatically place the door in the closed position when the male coupler is disconnected from the female coupler.

14. The coupling system of claim 12, wherein the door is connected to the female coupler housing, and the door control assembly is a door biasing assembly configured to bias the door into the closed position.

15. The coupling system of claim 12, wherein the door control assembly includes a spring configured to expand in response to opening of the door and compress to place the door in the closed position in response to the male coupler being removed away from the female coupler.

16. The coupling system of claim 12, wherein the female coupler housing is a female coupler housing, and the door comprises a dome-shaped portion for enhancing structural strength of the female coupler housing and resistance to entrance of environmental contaminants.

17. The coupling system of claim 12, wherein the bezel portion further comprises a runway configured to receive a mating end of the male coupler and to guide the mating end of the male coupler from an unaligned position outside of a peripheral edge of the bezel portion to an aligned position at the opening of the bezel portion, wherein the runway has a recessed surface that is substantially flush with the surrounding surface.

* * * * *